US012179980B2

(12) United States Patent
Ljungqvist

(10) Patent No.: US 12,179,980 B2
(45) Date of Patent: Dec. 31, 2024

(54) COATED PAPERBOARD FOR BEVERAGE CONTAINER CARRIERS AND CORRESPONDING BEVERAGE CONTAINER CARRIER

(71) Applicant: Stora Enso OYJ, Helsinki (FI)

(72) Inventor: Carl-Henrik Ljungqvist, Karlstad (SE)

(73) Assignee: Stora Enso OYJ, Helsinki (FI)

( * ) Notice: Subject to any disclaimer, the term of this patent is extended or adjusted under 35 U.S.C. 154(b) by 0 days.

(21) Appl. No.: 18/249,781

(22) PCT Filed: Oct. 19, 2021

(86) PCT No.: PCT/IB2021/059591
§ 371 (c)(1),
(2) Date: Apr. 20, 2023

(87) PCT Pub. No.: WO2022/084835
PCT Pub. Date: Apr. 28, 2022

(65) Prior Publication Data

US 2024/0010405 A1 Jan. 11, 2024

(30) Foreign Application Priority Data

Oct. 21, 2020 (SE) ..... 2051227-3

(51) Int. Cl.
*B65D 65/42* (2006.01)
*B65D 71/32* (2006.01)
(Continued)

(52) U.S. Cl.
CPC ..... *B65D 65/42* (2013.01); *B65D 71/32* (2013.01); *D21H 19/46* (2013.01);
(Continued)

(58) Field of Classification Search
CPC ..... B65D 65/42; B65D 71/32; B65D 2571/00444; B65D 2571/0066;
(Continued)

(56) References Cited

U.S. PATENT DOCUMENTS 4,425,405 A * 1/1984 Murakami ..... B41M 5/5254 428/323
4,900,620 A * 2/1990 Tokita ..... B41M 5/52 428/206
(Continued)

FOREIGN PATENT DOCUMENTS

CN 111655930 A 9/2020
EP 2682523 A1 1/2014
(Continued)

OTHER PUBLICATIONS

International Search Report from corresponding PCT application No. PCT/IB2021/059591, mailed Jan. 25, 2022.

*Primary Examiner* — Jacob K Ackun
(74) *Attorney, Agent, or Firm* — Greer, Burns & Crain, Ltd.

(57) ABSTRACT

The invention relates to a coated paperboard (10) for beverage container carriers (30) comprising: a paperboard substrate (12), a dispersion coating layer (18, 20) on each side (14, 16) of the paperboard substrate (12), wherein the paperboard substrate (12) comprises wet strength agents in an amount in a range from ≥0 wt % to ≤0.05 wt %, based on the dry solid content of the substrate (12) and sizing agents for making the paperboard (12) substrate more hydrophobic, wherein the sizing agents are present in an amount of ≥0.15 wt %, especially in a range from ≥0.15 wt % to ≤0.5 wt %, based on the dry solid content of the substrate (12). The invention further relates to a beverage container carrier (30) comprising or being made from the aforementioned coated paperboard (10).

18 Claims, 1 Drawing Sheet

Figure 1:
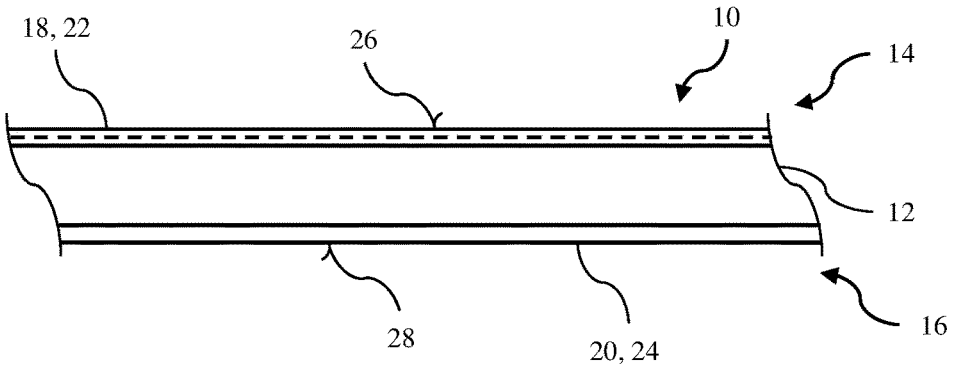

(51) Int. Cl.

| | |
|---|---|
| ***D21H 19/46*** | (2006.01) |
| ***D21H 19/82*** | (2006.01) |
| ***D21H 21/16*** | (2006.01) |
| ***D21H 21/20*** | (2006.01) |

(52) U.S. Cl.
CPC ..... *D21H 19/824* (2013.01); *D21H 21/16* (2013.01); *D21H 21/20* (2013.01); *B65D 2571/00444* (2013.01); *B65D 2571/0066* (2013.01); *B65D 2571/00716* (2013.01)

(58) Field of Classification Search
CPC ..... B65D 2571/00716; B21H 19/46; B21H 19/824; B21H 21/16; B21H 21/20
USPC ..... 206/429, 524.1, 524.3, 524.6
See application file for complete search history.

(56) References Cited

U.S. PATENT DOCUMENTS

| | | | | |
|---|---|---|---|---|
| 5,059,580 | A * | 10/1991 | Shibata | B41M 5/41 503/227 |
| 5,281,307 | A * | 1/1994 | Smigo | D21H 17/49 162/185 |
| 5,427,652 | A | 6/1995 | Darlington et al. | |
| 5,626,945 | A | 5/1997 | Berzins et al. | |
| 11,486,095 | B2 | 11/2022 | Nyflött et al. | |
| 2014/0300026 | A1 | 10/2014 | Taccolini | |
| 2016/0348318 | A1 | 12/2016 | Koenig et al. | |
| 2018/0066073 | A1 | 3/2018 | Spender et al. | |
| 2020/0056335 | A1 | 2/2020 | Chung et al. | |

FOREIGN PATENT DOCUMENTS

| | | | |
|---|---|---|---|
| JP | H10338266 | A | 12/1998 |
| WO | 2008008576 | A2 | 1/2008 |
| WO | 2013101778 | A2 | 7/2013 |
| WO | 2016195893 | A1 | 12/2016 |

* cited by examiner

COATED PAPERBOARD FOR BEVERAGE CONTAINER CARRIERS AND CORRESPONDING BEVERAGE CONTAINER CARRIER

This application is a U.S. National Phase under 35 U.S.C. § 371 of International Application No. PCT/IB2021/059591, filed Oct. 19, 2021, which claims priority under 35 U.S.C. §§ 119 and 365 to Swedish Application No. 2051227-3 filed Oct. 21, 2020.

The present invention relates to coated paperboard for beverage container carriers. The present invention further relates to a corresponding beverage container carrier comprising or being made from such coated paperboard.

Beverage container carriers like carriers for bottles and beverage cans (e.g. six packs for beer) are typically produced from paper board comprising a lot of wet strength agents as the package is commonly put in cold water for about an hour to chill the content. The package must be intact as the package is elevated from the water. This property is measured as Handle Integrity (HI) in a handle integrity test or in a cyclic drop test (CDT).

Such carrier wraps are known to be difficult to recycle and are banned or undesired at many recycling plants as they contain a significant amount of wet strength agents. Due to the addition of this wet strength agents the fiberboard is not properly disintegrated into pulp at normal recycling process conditions in recycling plants optimized for packaging waste such as OCC (OCC: old corrugated containers) or aseptic UBC and similar. In other words, the wet strength addition reduces recyclability performance of the carrier as the board disintegrates to flakes rather than pulp. This reduces pulp yield as the flakes are rejected. It will be rejected in the screening and cleaning processes and causes reduced pulp yield as well as additional costs for reject. Many recycling plants deny this kind of beer wraps as raw material in their processes for this reason.

Beverage multipacks are typical beverage container carriers, which are often made of multilayer packaging boards with (usually unbleached) Kraft layer on the back side (known as Kraft Back Board—KBB). A number of suppliers offer such kind of paperboards for multipacks, including the applicant, who refers to its multilayer Kraft back boards as "CKB Carrier™-Boards".

Document WO2008/008576 A2 describes a paperboard carton for packaging applications, such as a carrier for beverage containers like cans or bottles, having a selective reinforcement to enhance strength properties. The selected areas of the paperboard carton are reinforced by coating with a water-based formulation containing a water-based polymer and optionally pigment. In one variant of the paperboard the coating is applied to both sides of the paperboard substrate.

Document JPH 10338266 A describes a carrier for beverage containers like cans or bottles made from paperboard. One variant of this paperboard comprises internal sizing agents.

It has been observed that Handle Integrity (HI) performance for known carriers made from paperboard exhibit a heavy strength loss already at three minutes wetting in room temperature.

Thus it is the object of the invention to provide measures that increase the recyclability of paperboard from beverage container carriers without reducing the performance of these carriers significantly.

This object is achieved by the invention as defined by the independent claims. The dependent claims detail advantageous embodiments of the invention.

The invention provides a coated paperboard for beverage container carriers, the paperboard comprising a paperboard substrate and a dispersion coating layer on each side of the paperboard substrate, wherein the paperboard substrate comprises (i) wet strength agents in an amount in a range from ≥0 wt % to ≤0.05 wt %, based on the dry solid content of the substrate and (ii) internal sizing agents for making the paperboard substrate more hydrophobic in an amount of ≥0.15 wt %, especially in a range from ≥0.15 wt % to ≤0.5 wt %, based on the dry solid content of the substrate.

In other words: The paperboard substrate, which is a base of the board, comprises (i) substantially no wet strength agents, or wet strength agents in an amount of less than 0.5 kg/ton and at least 1.5 kg/ton internal sizing agents, and the board further comprises an aq. dispersion barrier coating applied on both sides of the substrate. The invention makes it possible to improve both the functional properties and the recyclability of the carrier. The proposed solution is replacing wet strength addition with a higher sizing dosage in combination with barrier sealing of the outer plies by means of dispersion coating. The idea is that the dispersion coating will prevent wetting from the surfaces and that the higher sizing dosage will prevent raw edge penetration, while the board is recyclable. Thus, the solution reduces strength loss when subjected to water compared to conventional beverage container carriers made from paperboard and improves recyclability at the same time.

As used herein, "paperboard substrate" or "baseboard" refers to a paper based substrate of an amalgamation of fibers that can include, at least in part, vegetable, wood, and/or synthetic fibers. The paperboard substrate preferably comprises cellulosic fibers. A typical paperboard substrate used for packaging material comprises at least one ply, preferably several plies. The paperboard substrate is preferably a multilayer paperboard, comprising at least two layers of a back ply and a top ply. The paperboard substrate may further comprise one or several middle plies. The paperboard substrate for example may comprise a top ply and a back ply and a middle ply.

The grammage (weight per unit area) of a paper layer or coating layer refers to the weight expressed as grams per square meter, gsm or $g/m^2$. As used herein, gsm and $g/m^2$ may be used interchangeable.

As used herein, "dispersion coating layer" refers to a layer that has been applied by dispersion coating onto the paperboard substrate. As used herein, "dispersion coating" refers to a coating technique where an aqueous dispersion of fine polymer particles is applied to the surface of a paper or paperboard to form a solid, substantially non-porous film after drying. The dispersion coating layers may be applied by the use of roller coating, spray coating, curtain, blade coating, slot coating, immersion coating, gravure roll coating, reverse direct gravure coating, rod coating, soft-tip blade coating and/or combinations thereof. Preferred coating methods are blade coating and rod coating. Dispersion coatings can be recycled. As used herein, "dispersion coated polyolefin" refers to polyolefin applied by dispersion coating.

Dispersion coating may be used to apply a layer providing barrier properties to the paperboard substrate. As used herein, a "barrier coating layer" or "barrier layer" refers to a coating layer providing barrier properties to the paperboard substrate by reducing or eliminating permeability, for example of gases such as oxygen through the material and/or the absorption of liquids in the fiber structure.

A "printing surface" is meant to define a surface adapted to be printed. The "print side" of a paperboard thus refers to the outward side of a package formed from the paperboard. An "inside" layer of a paperboard refers to the side intended to come into contact with a content in a package formed from the paperboard. Referring to the paperboard substrate comprising a first side and a second side, the first side refers to the "inside" or "reverse side" of a thereof formed package, while the second side refers to the "print side".

If not specifically denoted otherwise, given % are weight %, and are calculated on the basis of a dry weight of 100 weight % of the respective object, such as a layer, ply or packaging. The total amount of all components of a layer, ply or packaging does not exceed 100 wt %.

The dispersion coating layers are formed by dispersion coating. The dispersion layers may be applied by customary methods such as the use of roller coating, spray coating, curtain, blade coating, slot coating, immersion coating, gravure roll coating, reverse direct gravure coating, rod coating, soft-tip blade coating and/or combinations thereof. Preferably, the coating method is blade coating or rod coating. The method is usable for manufacturing a heat-sealable paperboard as described above.

As used herein, "pigment" refers to extenders, fillers and coatings such as clay, chalk or kaolin used for papermaking as usually referred to in the paper industry.

The water absorption rate (COBB 3600) is determined according to ISO 535:2014 Paper and Board—Determination of water absorptiveness—Cobb method, using a water absorption time of 60 minutes (3600 seconds).

The present invention will be further described in connection with various embodiments and other aspects. They may be combined freely unless the context clearly indicates otherwise.

According to a preferred embodiment of the invention internal sizing agents are added to the wet-end to increase the hydrophobicity of the board and can include both acid type sizing chemicals, basic or neutral sizing agents and can be e.g. alkyl ketene dimer (AKD), alkyl succinic anhydride (ASA) or rosin, or a combination of these.

The respective dispersion barrier coating/dispersion coating layer can be applied in one or more layers. In other words, at least one of the dispersion coating layers is formed as a dispersion coating layer applied in one layer or multi layers. Preferably, one dispersion coating layer is applied in one layer the other dispersion coating layer in two or more (sub-) layers.

The respective dispersion barrier coating/dispersion coating layer advantageously comprise a latex and/or a polyolefin. Preferably, the dispersion coating is wax-free—this further improves the recyclability. Preferably, the dispersion coating comprises latex and/or polyolefin in an amount of at least 30 wt %, e.g. between 30-100 wt %. The latex may be selected from styrene-butadiene latex, styrene-acrylate latex, acrylate latex, vinyl-acetate latex, acrylate latex, vinyl acetate latex, vinyl acetate-acrylate latex, styrene-butadiene-acrylonitrile latex, styrene-acrylate-acrylonitrile latex, styrene-butadiene-acrylate-acrylonitrile latex, styrene-maleic anhydride latex, styrene-acrylate-maleic anhydride latex, or mixture of these latexes. The polyolefin may be selected from polyethylene, polypropylene and/or copolymers of polyethylene and polypropylene.

The latex is preferably a styrene-butadiene (SB) latex or a styrene-acrylate (SA) latex, acrylate latex, vinyl acetate latex, or vinyl acetat-acrylate latex, or mixture of these latexes. The latex can be bio-based, i.e. derived from biomass, such as bio based styrene-acrylate or styrene-butadiene latex.

According to another embodiment of the invention the dispersion barrier coating further comprises pigments. The pigments may be selected from the group of clay (preferably kaolin clay), calcium carbonate and/or talc. In this context it is to be noted that the presence of pigments in the dispersion barrier coating enhances the recyclability of the coated board.

In addition to latex and pigments, the dispersion coating layer or layers may further comprise a small amount of additives, such as between 0.1-5 wt %, or 0.1-1, or 1-5 wt %, as calculated on the dry weight of said dispersion coating layer. Additives may include thickening agents, defoaming or antifoaming agents, dispersing aids, additional pigments, cross-linkers, slip additives, fillers, release agents, preservatives and antiblocking agents.

In accordance with another embodiment of the invention, the at least one dispersion coating layer comprises a cross-linker. Cross-linker as used herein is meant to define an agent that reacts with carboxyl- and/or hydroxyl groups.

The cross-linker is preferably chosen from the group of Ammonium Zirconium Carbonate (AZC), Potassium Zirconium Carbonate, Potassium Zirconium Acetate (Methylated) melamine formaldehyde resin or (methylated) urea formaldehyde resin, Glyoxal, Imidazoline derivatives, di-aldehyde polysaccharides and combinations thereof. The cross-linker is preferably added in an amount of between 0.1-5 wt %, or between 1-2 wt % as calculated on the dry weight of said dispersion coating layer. The cross-linker further improves the barrier properties e.g. by providing a denser and less porous coating layer. In addition, the smoothness of the surface is improved. In one preferred embodiment, the cross linker is chosen from the group of di-aldehyde polysaccharides such as dialdehyde cellulose (DAC) and di-aldehyde starch.

The base board is applied with the dispersion barrier coating on both sides—a need for this product since it will need to withstand being immersed in water for some time (to cool the beverages). The dispersion coating (forming at least one of the dispersion coating layers) is preferably applied at a coat weight of between 5-15 gsm on each side, preferably 5-12 or 6-10 gsm. In the example, a higher coat weight on one of the sides (the uncoated side) is chosen due to limitations in the coating technique used in the laboratory trial. In full scale, much thinner layers are possible.

The paperboard substrate comprises a first and a second side. In a carrier for beverage containers formed from the coated paperboard (the paperboard beverage container carriers) this second side will face the outside and provide the print-side of the carrier. In embodiments, the paperboard substrate comprises on the second side a dispersion coating layer of two sub-layers.

The term "Wet Strength Agents" refers to wet strength chemicals, typically wet strength resins, that improve the tensile properties of the paperboard in wet state by cross-linking the cellulose fibers with covalent bonds. Wet strength agents may include both permanent and temporary wet strength agents, e.g. of the urea resins, melamine resins, polyamidoamine-epichlorhydrine (PAAE) resins, PAM-glyoxal resins, glyoxal, glyoxal resins, dialdehyde-starch.

According to another preferred embodiment of the invention the COBB (3600) called water absorption rate of the coated paperboard after 3600 s is ≤20 gsm, preferably ≤10 gsm.

The water absorption of the coated paperboard after being wetted in 60 minutes is preferably ≤20 wt %, more preferably ≤10 wt %.

With advantage the Wick index of the coated paperboard is ≤3 kg/m$^2$, preferably ≤2 kg/m2 and more preferably ≤1 kg/m$^2$.

According to yet another preferred embodiment of the invention the tensile index GM of the coated paperboard after 1 h in water is ≥15 Nm/g, preferably ≥20 Nm/g especially ≥30 Nm/g.

The substrate/base board is preferably a multiply base board, comprising a plurality, e.g. three, layers. It may comprise bleached, or unbleached pulp. Preferably a larger part chemical pulp, but it may also comprise mechanical pulp (such as CTMP.) preferably in the middle ply.

In embodiments wherein the base board comprises only chemical pulp, the amount of internal sizing can be somewhat lower, e.g. 1.5-2.5 kg/ton or 1.9-2.5 kg/ton. In embodiments, wherein the base board comprises mechanical pulp, the amount of internal sizing can be higher. If the base board comprises 30-50 wt % mechanical pulp, the internal sizing can be e.g. 2.5-6 kg/ton or 3-5 kg/ton.

In one embodiment the base board is pigment coated before being coated with the dispersion coating.

The invention further relates to a beverage container carrier comprising or being made from the aforementioned coated paperboard. In other words, the invention further relates to the use of the aforementioned coated paperboard to build a beverage container carrier.

In accordance with an embodiment of the beverage container carrier according to the invention, the carrier comprises a handle formed by a structure in the coated paperboard and/or a structure made of the coated paperboard. The structure in the coated paperboard preferably is one or more carrying holes. The structure made of the coated paperboard preferably is one or more carrying straps.

According to another embodiment of the invention, the main component of this carrier is a blank of the coated paperboard, which blank forms essentially the entire carrier. Other components are usually only fixing materials such as glue, staples, etc.

According to yet another embodiment of the invention, the basic shape of the carrier is that of open ended tubular carton with a top wall, two side walls and a bottom wall which is formed by wrapping the coated paperboard about the corresponding beverage containers.

Figure 2:
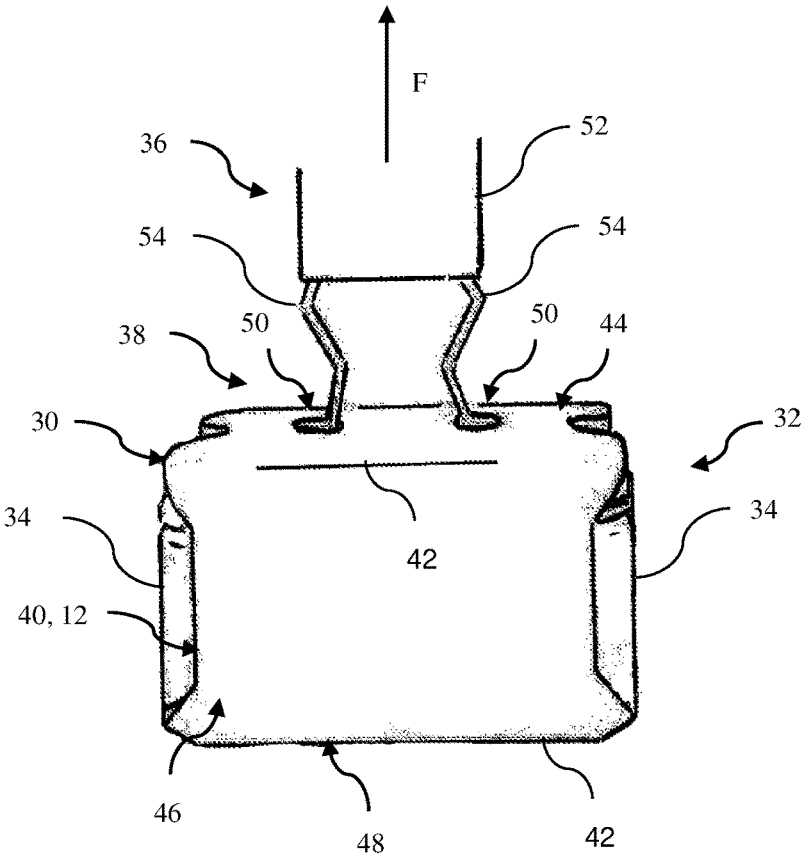

Further features of the present invention will become apparent from the example and figures, wherein:

FIG. 1 shows a schematic sectional view of a coated paperboard according to a preferred embodiment of the invention, and, FIG. 2 shows a beverage container carrier according to a preferred embodiment of the invention on a test stand for testing the handle integrity (HI).

In FIG. 1 a sheet of coated paperboard 10 is shown in a schematic sectional view. The coated paperboard 10 comprises a paperboard substrate 12 having a first side 14 (upper side in the figure) and a second side 16 (bottom side in the figure), wherein each of these sides 14, 16 is coated by a respective a dispersion coating layer 18, 20.

The paperboard substrate 12, which is a base of the board 10, comprises (i) wet strength agents in an amount of less than 0.5 kg/ton and at least 1.5 kg/ton internal sizing agents. The dispersion coating layers 18, 20 are aq. dispersion barrier coatings applied on both sides 14, 16 of the paperboard substrate 12. In the example shown here in FIG. 1 the dispersion coating layer 18 on the first side 14 is a dispersion coating layer 22 applied in two sub-layers and the dispersion coating layer 20 on the second side 14 is a dispersion coating layer 24 applied in one single layer.

Within the paperboard substrate 12 a wet strength addition is replaced at least in part by a higher sizing dosage (HS BB: Hard Sized Baseboard) in combination with barrier sealing of the outer plies by means of a dispersion coating (DB: Dispersion Barrier) on each side (dispersion coating layers 18, 20) of the paperboard substrate 12 (HS BB). The dispersion coating layers 18, 20 prevent wetting from the surfaces 26, 28 of the board 10 and the higher sizing dosage within the paperboard substrate 12 will prevent raw edge penetration, while the board 10 is recyclable. These measures reduce strength loss when wetted compared to the material of conventional beverage container carriers made from paperboard and improves recyclability at the same time.

The material as shown in FIG. 1 is particularly suitable for the manufacture of beverage container carriers 30 as shown in FIG. 2. The coating layer 22 applied in two layers is preferably on the outside of the respective beverage container carrier 30 and the coating layer 24 applied in one layer is preferably on the inside.

FIG. 2 shows a package 32 with a plurality of beverage containers 34 and a beverage container carrier 30 on a test stand 36 for testing the handle integrity of a handle 38 of the beverage container carrier 30.

The beverage containers 34 of the package 32 shown in FIG. 2 are beverage cans. The illustrated package 32 comprises an assembly of six beverage containers 34 enclosed in an open ended tubular carton which is formed by wrapping about the beverage containers 34, while the beverage containers 34 are grouped in double row, transversely aligned triplets, a cut and scored blank 40 of the coated paperboard 10 and securing the ends of the blank 40 in a manner which results in the carton walls being tightly drawn about the group of beverage containers 34 so as to form a tightly wrapped package 32 and insure that the beverage containers 34 will be retained in the carton under normal handling of the package 32.

The package structure is formed by wrapping the blank 40 about the group of beverage containers 34 which are arranged in double row and in transversely alignment, and securing the ends of the blank 40 while the bottom wall forming panels are drawn inwardly of the sidewall forming panels by the folding operations (not explicitly shown). The beverage containers 34 are of well-known configuration. It will be understood that the blank 40 may be modified to adapt it to the packaging of beverage bottles and other articles of the same or similar configuration, i.e. other kinds of beverage containers 34.

The blank 40 is an elongate rectangular sheet of the coated paperboard 10, which is of suitable weight or gauge and which is cut and scored so that it is symmetrical about a longitudinal center line running intermediate its side edges. It is divided by longitudinally spaced hinge forming folding lines 42 (score lines) which extend in parallel relation transversely of the blank 40, and divide it into a top wall 44 forming center panel section, adjoining sidewall 46 forming panel sections and bottom wall 48 forming end panel sections, the latter having at their terminal end portions end panel connecting strips or locking and latching strips of relatively narrow width, the inner edges of which are defined by the hinge score lines, respectively (not shown). The center panel section (forming the top wall 44) comprises semi-elliptically opposed lines for forming package carrying holes 50, which serve as the handle 38. In other words, the handle 38 is directly formed by structures of blank 40 or the coated paperboard 10.

The test stand 36 is arranged for testing the handle integrity of the handle 38. In a corresponding handle integrity test the filled package 32 is clamped or physically held down while a pulling device 52 of the test stand holds the handle 38. For this purpose, the device here in the example uses finger-shaped elements 54. The pulling device 52 pulls the handle 38 of the (multi-pack) carrier 30 until it fails. A load cell measures the force as the handle 38 is pulled to failure. The result of the test includes the peak force (Fmax) at failure and a description of the location of the handle failure.

The generally accepted rule in beverage packaging is that the force required to cause handle failure must be at least three times the weight of the package 32.

Wet handle strength testing is performed by submerging a filled package 32 in water for 3 minutes, then testing the handle strength of the handle 38 as in the dry test. Naturally the paperboard 10 and glue used in the package 32 must be designed for a wet environment.

Table 1 shows a comparison of the properties of the coated paperboard 10 according to a preferred embodiment of the invention compared to boards of different design. The coated paperboard 10 according to the embodiment of the invention is called HS BB+DB (hard sized base board HS BB with dispersion barrier DB). The reference board (REF) is a conventional Kraft Back Board (KBB) according to prior art, which comprises a high amount of wet strength agents. KKB+DB (REF 2) is the reference (comprising a high amount of wet strength agents), but with a dispersion barrier. HS BB (REF 3) is a base board that comprises a high amount of internal sizing agents; HS BB+DB is the concept according to the invention (INV), comprising a high amount of internal sizing agents and a dispersion barrier.

The dispersion coating applied to the HS BB+DB (Inv) was applied to the base board at a coat weight of 6 gsm on the print side and 15 gsm on the back side. The dispersion was a polyolefin dispersion (100%) with no pigments.

The "grammage relative to KKB" is the grammage relative to the reference KBB. This is included in the calculation of some of the results—HI (Handle Integrity) and CDT (cyclic drop test) show both absolute values and values that are weighted to the ref grammage. This because the grammage also influence this value.

The strength properties for the reference is shown both as dry and after being wetted/immersed in water at 23° C. for 60 minutes. For the other samples (including the HS BB+DB) the strength properties are shown after 60 minutes immersed in water.

As can be seen from the results, the Handle integrity of carriers made from the reference is highly reduced after the carrier has been immersed in water. The application of a dispersion barrier improves the HI somewhat, while the exchange of wet strength agents to internal sizing agents makes it even worse. By the concept of the invention, the handle integrity also after the carrier has been immersed in water for 60 minutes is almost at the same level as the reference when this is dry.

Table 2: "Board+ISO" shows both the methods used and some description of the sample boards. Most of the properties are measured by use of standard methods, while Wick Index (Raw edge water absorption), Cyclic Drop Test (CDT) and Handle Integrity are not standard methods and links to description of these are included.

TABLE 1 comparison of the properties of a coated paper board according to one embodiment of the invention compared to paper boards of a different design.

| Property | Unit | | | | | |
|---|---|---|---|---|---|---|
| DB = Dispersion Barrier<br>HS BB = Hard Sized Baseboard | | KBB (REF) | KBB (REF) | KBB + DB (REF 2) | HS BB (REF 3) | HS BB + DB (INV) |
| Wetting time | Time/min | 0 (Dry) | 60 | 60 | 60 | 60 |
| Sample | | KBB (Dry) | KBB (60) | KBB + DB (60) | HS BB (60) | HS BB + DB (60) |
| Grammage | $g/m^2$ | 326.4 | 326.4 | 346.6 | 319 | 339.7 |
| Grammage relative to KBB-REF | % | 100% | 100% | 106% | 98% | 104% |
| Handle Integrity (HI) | Fmax(N) | 232.69 | 51.4 | 154.1 | 36.32 | 223.3 |
| HI relative to KBB-REF grammage | Fmax(N) | 233 | 51 | 145 | 37 | 250 |
| Cyclic drop test (CDT) | Cycles to Failure | 34.8 | 2.0 | 19.7 | 0.8 | 45.1 |
| CDT rel. to KBB REF grammage | Cycles to Failure | 35 | 2 | 19 | 1 | 43 |
| Cobb TS | g/m2 | NA | 149 | 6.3 | 121 | 9 |
| Water abs. (Tensile test sample. Average MD and CD. %) | % | 6.4 | 68.4 | 49.0 | 51.3 | 12.1 |
| Wick index water 60 min | $kg/m^2$ h | NA | NA | 3.28 | NA | 0.66 |
| Tensile index GM | Nm/g | 64.30 | 9.16 | 12.57 | 6.89 | 32.06 |
| Tensile stiffness index GM | kNm/g | 5.51 | 0.53 | 0.70 | 0.61 | 2.76 |

TABLE 2

| sheet "Board + ISO" | | | | | |
|---|---|---|---|---|---|
| | Actual Board Basis | | BB = Base Board except pigment coating Sizing (AKD, ASA, Rosin or etc or a combination) | | |
| # Name | weight (incl. pigment coating) g/m² | Base Board weight (actual) g/m² | Thick-ness (actual) μm | Sizing kg/ton BB | Wet Strength Agents kg/ton BB |
| REF KKB | 326 | 308 | 502 | 1.4 | 0.8 |
| REF 3 HS BB | 319 | 301 | 509 | 2.7 | 0 |
| REF 2 KKB + DB | 6 + 326 + 15 = 347 | 326 | 502 | 1.4 | 0.8 |
| HS BB + DB | 6 + 319 + 15 = 340 | 319 | 509 | 2.7 | 0 |

The wick index defines the edge penetration and is measured by an edge penetration test—EWT (Edge Wick Test) according to the following method: paperboard samples are covered on both sides with waterproof tape (or, as in the present case, only with existing barrier coating), and cut to a specific size. The samples are conditioned at 23° C., 50% RH for 10 minutes, after which thickness and weight of the samples are measured. Thereafter, the samples are put into a test solution, particularly water, (bath) for a certain period of time. The wick index for is then calculated by the formula:

$$E = \frac{W2 - W1}{t \times l}$$

wherein E is the wick index (kg/m2), W1 is the weight before bath (mg), W2 is the weight after bath (mg), t is the thickness (μm) and 1 is the total length of the edges of the samples.

REFERENCE SIGNS

10 coated paperboard
12 paperboard substrate
14 first side
16 second side
18 dispersion coating layer (first side)
20 dispersion coating layer (second side)
22 layer applied in two sub-layers
24 layer applied in one single layer
26 surface (coated paperboard)
28 surface (coated paperboard)
30 beverage container carrier
32 package
34 beverage container
36 test stand
38 handle
40 blank
42 folding line
44 top wall
46 side wall
48 bottom wall
50 package carrying hole
52 pulling device
54 finger-shaped elements

The invention claimed is:

1. A coated paperboard for beverage container carriers comprising:

a paperboard substrate, a dispersion coating layer on each side of the paperboard substrate, wherein the paperboard substrate comprises wet strength agents in an amount in a range from ≥0 wt % to ≤0.05 wt %, based on a dry solid content of the paperboard substrate and sizing agents for making the paperboard substrate more hydrophobic, wherein the sizing agents are present in an amount of ≥0.15 wt %, based on the dry solid content of the paperboard substrate.

2. The paperboard according to claim 1, wherein the sizing agents are selected from a group consisting of: acidic sizing agents, basic sizing agents, neutral sizing agents or a mixture of at least two of these types.

3. The paperboard according to claim 1, wherein the sizing agents are selected from a group consisting of: alkyl ketene dimer, alkyl succinic anhydride, rosin or a mixture thereof.

4. The paperboard according to claim 1, wherein at least one of the dispersion coating layers is a dispersion coating layer applied in one single layer or two sub-layers.

5. The paperboard according to claim 1, wherein at least one of the dispersion coating layers comprises latex, polyolefin, or both.

6. The paperboard according to claim 5, wherein the latex is selected from the group consisting of: styrene-butadiene latex, styrene-acrylate latex, acrylate latex, vinyl acetate latex, vinyl acetate-acrylate latex, styrene-butadiene-acrylonitrile latex, styrene-acrylate-acrylonitrile latex, styrene-maleic anhydride latex, styrene-acrylate-maleic anhydride latex, or a mixture of any combination of these latexes.

7. The paperboard according to claim 5, wherein the at least one dispersion coating layer further comprises pigments.

8. The paperboard according to claim 5, wherein the at least one dispersion coating layer further comprises additives in an amount in a range ≥0.1 wt % and ≤5 wt %, wherein the additives include at least one of thickening agents, defoaming or antifoaming agents, dispersing aids, additional pigments, cross-linkers, slip additives, fillers, release agents, preservatives and antiblocking agents.

9. The paperboard according to claim 5, wherein the at least one dispersion coating layer further comprises a cross-linker, which is an agent reacting with carboxyl, hydroxyl groups, or both.

10. The paperboard according to claim 9, wherein the cross-linker is selected from a group consisting of: Ammonium Zirconium Carbonate, Potassium Zirconium Carbonate, Potassium Zirconium Acetate, melamine formaldehyde resin, urea formaldehyde resin, Glyoxal, Imidazoline derivatives, di-aldehyde polysaccharides and any combinations of these group members.

11. The paperboard according to claim 1, wherein the wet strength agents comprise at least one selected from the group consisting of: urea resins, melamine resins, polyamidoamine-epichlorhydrine resins, PAM-glyoxal resins, glyoxal, glyoxal resins, and dialdehyde-starch.

12. The paperboard according to claim 1, wherein the COBB 3600 called water absorption rate of the coated paperboard after 3600 s is ≤20 gsm.

13. The paperboard according to claim 1, wherein the water absorption of the coated paperboard after being wetted in 60 minutes is ≤20 wt %.

14. The paperboard according to claim 1, wherein the Wick index of the coated paperboard is ≤3 $kg/m^2$.

15. A beverage container carrier comprising the coated paperboard according to claim 1.

16. The beverage container carrier according to claim 15, wherein the carrier comprises a handle formed by a structure in the coated paperboard, and/or a structure made of the coated paperboard, or both.

17. The beverage container carrier according to claim 15, wherein the main component of this carrier is a blank of the coated paperboard.

18. The beverage container carrier according to claim 15, wherein a shape of the carrier is that of open ended tubular carton with a top wall, two side walls and a bottom wall which is formed by wrapping the coated paperboard about the beverage containers.

* * * * *